United States Patent [19]

Hammond et al.

[11] Patent Number: 4,899,087

[45] Date of Patent: Feb. 6, 1990

[54] TRIGGERING CIRCUIT FOR SERIES CONNECTED FLASH LAMPS

[75] Inventors: Thomas J. Hammond; Lawrence J. Mason, both of Penfield, N.Y.

[73] Assignee: Xerox Corporation, Stamford, Conn.

[21] Appl. No.: 180,680

[22] Filed: Apr. 8, 1988

Related U.S. Application Data

[63] Continuation of Ser. No. 014,001, Feb. 12, 1987, abandoned.

[51] Int. Cl.[4] ..... H05B 37/00

[52] U.S. Cl. ..... 315/241 P; 315/291; 315/307; 315/DIG. 5; 315/178; 315/200 A

[58] Field of Search ..... 315/241 P, 241 S, 178–179, 315/185–188, 193, 200 A, 200 C, 291, 307, DIG. 5, 323–324

[56] References Cited

U.S. PATENT DOCUMENTS

| | | | |
|---|---|---|---|
| 2,900,577 | 8/1959 | Feinberg | 315/187 |
| 3,225,255 | 12/1965 | Hume | 315/188 |
| 3,324,349 | 6/1967 | Moerkens et al. | 315/188 |
| 3,372,300 | 3/1968 | Furvi | 315/193 |
| 3,397,343 | 8/1968 | Furui | 315/189 |
| 3,399,327 | 8/1968 | Furvi | 315/193 |
| 3,733,599 | 5/1973 | Fantozzi | 340/343 |
| 3,777,135 | 12/1973 | Rees | 240/41.35 R |
| 3,846,811 | 11/1974 | Nakamura et al. | 354/145 |
| 3,975,660 | 8/1976 | Knobel et al. | 315/DIG. 5 |
| 4,006,384 | 2/1977 | Elms et al. | 315/324 |
| 4,037,136 | 7/1977 | Hoene | 315/241 P |
| 4,075,476 | 2/1978 | Pitel | 315/DIG. 5 |
| 4,246,514 | 1/1981 | Metzger | 315/324 |
| 4,250,538 | 2/1981 | Durbin et al. | 362/97 |
| 4,333,723 | 6/1982 | Green et al. | 355/71 |
| 4,404,498 | 9/1983 | Spiteri | 315/200 A |
| 4,534,035 | 8/1985 | Long | 315/188 |
| 4,555,648 | 11/1985 | Iida et al. | 315/241 P |
| 4,588,924 | 5/1986 | Luursema et al. | 315/DIG. 5 |
| 4,652,108 | 3/1987 | Iida et al. | 315/241 P |
| 4,673,845 | 6/1987 | Yamada | 315/241 P |
| 4,677,347 | 6/1987 | Nakamura | 315/241 P |

OTHER PUBLICATIONS

"Pulsed Light Sources", I. S. Marshak, Plenum Pub. Corp., (1984), p. 358.

*Primary Examiner*—Leo H. Boudreau
*Assistant Examiner*—Michael Razavi

[57] ABSTRACT

Lamp operating voltage levels are reduced by using a boost circuit to initiate a triggering sequence in one of two lamps connected in series. The boost circuit is connected across one of the lamps at a connector point common to the two lamps. In a preferred embodiment, trigger pulses are applied sequentially to each lamp, the boost circuit voltage contained in an associated capacitor is discharged through the first triggered lamp, causing it to begin conduction. Most of the voltage from a main storage capacitor then becomes available to break down the second lamp.

5 Claims, 1 Drawing Sheet

TRIGGERING CIRCUIT FOR SERIES CONNECTED FLASH LAMPS

This is a continuation of application Ser. No. 014,001, filed Feb. 12, 1987.

The present invention is generally directed towards a control circuit for providing a trigger signal to a flash lamp and, more particularly, to a boost voltage starting circuit for series-connected flash lamps used in a document flash exposure reproduction system.

Document reproduction machines capable of high copy output typically use flash lamps positioned beneath a document platen. The lamps are pulsed at the desired repetition rate providing a rapid succession of document exposure projected by an associated lens onto a photosensitive image plane. Examples of prior art flash exposure systems are disclosed in U.S. Pat. Nos. 3,777,135; 4,250,538; and 4,333,723.

In order to enable high-speed, repetitive discharge of the flash lamp, a trigger pulse voltage is usually applied externally to the lamp envelope along a wire which is adjacent to, or wound around, the tube. The trigger pulse ionizes the gas inside the lamp envelope, forming a conductive path and allowing a dc power supply associated with the lamp to discharge through the tube to generate the flash.

A serious problem when using a trigger circuit is the high voltages which must be generated to ensure reliable starts. The high voltages increase the power requirements of the system and introduce undesirable noise which can interfere with system computer control circuitry. Another disadvantage is the increased heat build-up during extended modes of operation, causing an increase in the gas pressure in the lamp and making starting more difficult. These problems are compounded when a particular system requires more than one lamp to provide the required document illumination. Such series-connected multi-lamp systems require higher trigger voltage than single-lamp systems. Higher starting voltages, in addition to the problems mentioned above, also limit exposure control which can be obtained by varying the lamp charge voltage to the lamp power supply storage capacitor, because it limits operation to the higher voltages.

Prior art triggering techniques have addressed the high voltage requirement problems in various ways with the exception of the apparatus shown in U.S. Pat. No. 3,733,599. As disclosed, the flash lamp, or lamps, are positioned within grooves formed in a conductive body. The initial contact between the conduction surface and the lamp envelope causes the gas within the lamp envelope to ionize more readily, resulting in lower trigger voltage requirements. Other trigger circuits for triggering multiple lamp arrangements are disclosed in U.S. Pat. Nos. 3,324,349 and 3,397,343. These patents are directed towards triggering techniques for series-connected gas lamps such as fluorescent lamps powered by an ac voltage and do not disclose lower trigger requirements for dc powered flash lamps. U.S. Pat. No. 3,846,811 discloses exposure control methods for low power flash modes such as camera flash systems. U.S. Pat. No. 4,037,136 discloses a triggering technique which eliminates the need for an external trigger wire adjacent to the lamp envelope but the technique apparently requires at least as high, or higher voltage levels, from the trigger voltage signal generator 5 shown in the figures.

The present invention is therefore directed towards a triggering circuit for series-connected dc operated flash lamps which trigger the lamps into operation at lower main discharge capacitor than possible with conventional prior art circuitry. The lower voltage is enabled by a boost voltage starting circuit which is connected to a common point between series-connected lamps and the return line of the power supply. The boost voltage, at a relatively low level, enables the low lamp to be triggered first. The discharge in the first lamp causes a lowering of voltage across this first lamp, which results in an increase in voltage across the second lamp. The second lamp, in response to the trigger pulse, will begin to conduct. Both lamps will then discharge the main capacitor, resulting in the output flash. (Boost starting circuits for single lamps are known in the art; for example, see p. 358 "Pulsed Light Sources", I. S. Marshak, Plenum Publishing Corp., (1984) which contains a conventional boost circuit for a single lamp and requires the use of expensive diodes to conduct the main lamp current. More particularly, the invention is directed towards a triggering circuit for series-connected flash lamps, comprising:

a main dc power source connected across an energy storage capacitor, said power source charging said capacitor connected in parallel across the series-connected lamps;

means for providing a low level trigger signal to each of the lamps; and a boost voltage circuit connected to a common point between said flash lamps, said boost circuit comprising a dc voltage source connected across one of the lamp electrodes, said power source charging a second capacitor connected in parallel across said selected lamp.

For an understanding of the features of the present invention, reference is made to the drawings.

Figure 1:
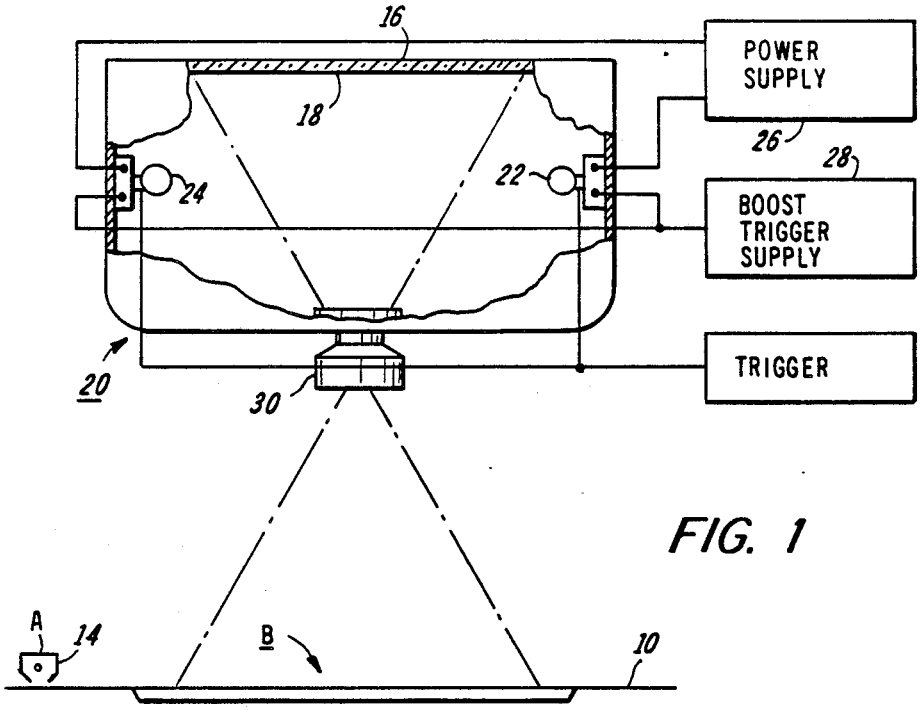
FIG. 1 is a schematic side view of a flash illumination imaging system incorporating the flash lamps and associated trigger circuit of the present invention.

Turning now to FIG. 1, an imaging system for a document reproduction machine uses a photoreceptor belt 10 having a photoconductive surface formed on a conductive substrate. Belt 10, a portion of which is shown, moves in the indicated process direction, advancing sequentially through the various xerographic process stations beginning with a charging station A, and continuing through exposure station B. Other xerographic stations including image development transfer and cleaning are not shown but are well known in the art.

With reference to FIG. 1, a portion of belt 10 passes through charging station A where a corona generating device, indicated generally by the reference numeral 14, charges the belt surface to a relatively high, substantially uniform, potential.

As belt 10 continues to advance, the charged portion of the surface moves into exposure station B. An original document 16 is positioned, on the surface of a transparent platen 18. The illumination system comprises a light housing 20 the top surface of which is defined by platen 18. Within housing 20 are flash lamps 22, 24, connected in series to a dc power supply 26. Connected to a common point between lamps 22, 24 (as shown in FIG. 2) is boost trigger circuit 28.

Lens 30 is seated in an aperture formed in the housing floor. All the interior surfaces of the housing are coated with a high reflectivity material, thereby making these surfaces diffusely reflective to light impinging thereon. When lamps 22, 24 are triggered (typically initiated by actuation of a PRINT button or the like) the lamps are energized by power supply 26. The pulsed light output is directed against the interior coated surfaces, undergoing one or more reflections and irradiating the underside of the platen with a generally uniform level of illumination. The housing thus efficiently functions as a light-integrating cavity which provides a generally uniform illumination level along the bottom of the object plane.

Figure 2:
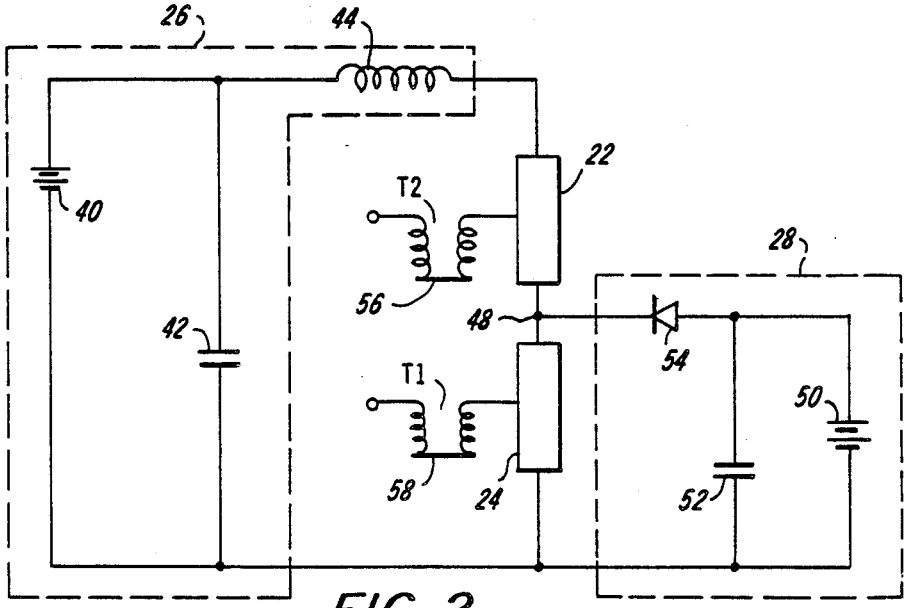
FIG. 2 is a preferred embodiment of the dc power supply and boost voltage trigger circuit of the present invention.

Referring now to FIG. 2, there is shown a preferred embodiment of the boost circuit of the present invention. DC power supply 26 consists of a variable dc source 40 in parallel with a main storage capacitor 42 which is in parallel with lamps 22, 24 and an inductor 44. Boost trigger circuit 28 is shown connected to the common point 48 of series-connected lamps 22, 24. The boost circuit consists of a dc voltage source 50, boost capacitor 52 in parallel with lamp 24 and diode 54. The trigger wires 56, 58 are placed in contact with the envelope of lamps 22, 24, respectively.

In operation, upon initiation of a "PRINT" command a trigger signal is applied sequentially, first to trigger wire 58 and then wire 56 via transformers $T_1$ and $T_2$, respectively, causing the lamps 24 and 22, respectively to begin to break down and current begins to flow through both lamps. Capacitor 52, whose capacity is much less, relative to capacitor 42, begins to discharge through lamp 24. The boost voltage $V_B$, which can be as low as several hundred volts, is applied across lamp 24, accelerating the breakdown of lamp 24. Capacitor 52 discharges through lamp 24. According to the principles of the present invention, it has been found that the boost circuit pulse is very short (in the order of a few μsec), and that the boost current through lamp 24 can be several hundred amps even with a relatively small boost voltage.

Proceeding with the operational sequence, the boost current through lamp 24 following application of the signal along wire 58, impresses the main voltage from supply 40, minus the lamp 24 voltage drop across lamp 22. Thus, almost the entire voltage stored in capacitor 42 is impressed across lamp 22. Once lamp 22 operation is initiated, both lamps will discharge capacitor 42, drawing the same current through each lamp. Following complete discharging, both capacitors are recharged and a subsequent firing can be initiated.

EXAMPLE

In one example, capacitor 42 has a capacity of 25 uf; capacitor 52, 0.1 uf; lamps 22 and 24 were filled with Xenon gas. A trigger signal was applied sequentially to trigger wire 58, 56. Without boost circuit 28, the two lamps required a minimum voltage of 1250 volts to be applied from power supply 40. With a boost circuit supply of 2000 volts, this minimum voltage was reduced to 600 volts. For these low voltage levels, the sequential trigger signals were separated by an interval of approximately 100 μsec.

Other operating parameters are possible consistent with the principles of the present invention. For example, lower boost voltages could be used, with correspondingly higher operating voltages; e.g. a boost voltage of 850 volts resulted in an increase in operating voltage to 850 volts.

It may be desirable for some systems, to apply the trigger signals simultaneously. For the example above, the boost voltage would have to be maintained at least at a 2000 volt level and the boost voltage capacitors increased to 0.2 uf, then the main operating voltage can be reduced to 600 volts.

While the invention has been described with reference to the structure disclosed, it is not confined to the details set forth, but is intended to cover such modifications or changes as may come within the scope of the following claims:

What is claimed is:

1. A circuit for causing high speed, repetitive discharge of a pair of flash lamps connected in series, said circuit comprising:

a main dc power supply connected across said series connected flash lamps, said main power supply adapted to provide the flash energy to said lamps to sustain discharge;

a trigger circuit for initiating flash operation by providing a low level trigger signal to each lamp and a preflash boast voltage circuit for providing a boost voltage across a first flash lamp and across a common electrical connection between the two lamps, said boost voltage circuit including an auxilary dc power supply, for charging a boost capacitor connected in parallel across said first lamp and further including a blocking impedance connected between said capacitor and said common electrical connection, said boost voltage circuit adapted to charge said boost capacitor prior to initiation of flash operation, whereby, when flash operation is initiated, said trigger signals are applied initiating current flow in both lamps and the boost voltage is applied across said first lamp lowering the impedance of said first lamp and accelerating the breakdown of the second lamp.

2. The circuit of claim 1 wherein said main power supply has a main capacitor connected in parallel across each lamp and wherein the capacity of said boost capacitor is at least an order of magnitude less than the capacity of said main capacitor.

3. The circuit of claim 2 wherein the voltages applied to said main and boost capacitor are substatially equal.

4. The circuit of claim 3 wherein said trigger pulses are applied simultaneously.

5. The circuit of claim 1 wherein said trigger pulses are applied sequentially, the first pulse being applied to said first lamp connected across the boost circuit.

* * * * *